US005129371A

United States Patent [19]

Rosalik, Jr.

[11] Patent Number: 5,129,371

[45] Date of Patent: Jul. 14, 1992

[54] CAM COVER OIL SEPARATOR FOR CRANKCASE VENTILATION

[75] Inventor: Martin E. Rosalik, Jr., Oakland Township, Oakland County, Mich.

[73] Assignee: Saturn Corporation, Troy, Mich.

[21] Appl. No.: 754,511

[22] Filed: Sep. 3, 1991

[51] Int. Cl.[5] ..... F01M 9/10

[52] U.S. Cl. ..... 123/90.38; 123/41.86

[58] Field of Search ..... 123/90.37, 90.38, 41.86, 123/195 C, 572

[56] References Cited

U.S. PATENT DOCUMENTS

| | | | |
|---|---|---|---|
| 4,569,323 | 2/1986 | Okumura | 123/41.86 |
| 4,597,372 | 7/1986 | Furukawa | 123/572 |
| 4,602,595 | 7/1986 | Aoki et al. | 123/90.38 |
| 4,607,604 | 8/1986 | Kanoh et al. | 123/572 |
| 4,627,406 | 12/1986 | Namiki et al. | 123/573 |
| 4,667,647 | 5/1987 | Ohtaka et al. | 123/573 |
| 4,686,946 | 8/1987 | Umeda et al. | 123/90.38 |
| 4,721,090 | 1/1988 | Kato | 123/572 |
| 4,723,529 | 2/1988 | Yokoi et al. | 123/573 |
| 4,844,032 | 7/1989 | Groeger et al. | 123/196 R |
| 4,958,613 | 9/1990 | Hiraoka et al. | 123/572 |
| 4,993,375 | 2/1991 | Akihiko | 123/90.38 |
| 5,005,553 | 4/1991 | Washizu et al. | 123/572 |
| 5,022,376 | 6/1991 | Hudson, Jr. et al. | 123/41.86 |
| 5,058,542 | 10/1991 | Grayson et al. | 123/90.38 |
| 5,063,882 | 11/1991 | Koch et al. | 123/41.86 |
| 5,069,192 | 12/1991 | Matsumoto et al. | 123/572 |

FOREIGN PATENT DOCUMENTS

| | | | |
|---|---|---|---|
| 3326881 | 8/1984 | Fed. Rep. of Germany | 123/41.86 |

*Primary Examiner*—E. Rollins Cross
*Assistant Examiner*—Weilun Lo
*Attorney, Agent, or Firm*—Robert J. Outland

[57] ABSTRACT

A cam cover for an overhead cam engine has first and second oil separators connecting the crankcase with the engine induction system high and low vacuum portions as part of a crankcase ventilation system. The separators each have a floor sloping toward the outlet and forming a sump with a drain to the crankcase. A large slow flowing separation chamber precedes the sump. An optional inlet tube is angled down with a large inlet facing away from the oil splash. A shelf may extend between the sump and the outlet end to deter oil carry-over to the outlet. Optional PCV valve and oil filler locations are shown.

6 Claims, 5 Drawing Sheets

CAM COVER OIL SEPARATOR FOR CRANKCASE VENTILATION

TECHNICAL FIELD

This invention relates to the crankcase ventilation systems of engines of the overhead cam type and particularly to oil separators in the cam covers of such engines.

BACKGROUND

It is known in the art relating to engines to provide a crankcase ventilation system with one or more oil separators in the cam or valve covers. The separator(s) control the carryover of oil from the crankcase to the engine cylinders through the positive crankcase ventilation (PCV) connections.

In overhead cam (OHC) engines, a large amount of oil is thrown from the camshaft and other moving parts in and above the cylinder head, mixing with a turbulent air mass to create a body of rapidly moving air and oil droplets and mist. Oil sloshing about the cylinder head surfaces prior to being drained to the engine sump adds to the body of active air-oil mixture.

As a result, the development of a cam cover mounted oil separator capable of fitting in the available confined space and of adequately limiting the escape of oil from the engine through the ventilation system under the various engine and vehicle operation conditions is a substantial challenge.

SUMMARY OF THE INVENTION

The present invention provides an OHC engine cam cover with an oil separator for crankcase ventilation that is both simple and compact in construction and yet provides efficient separation of oil droplets from the crankcase gas drawn from the cam cover into the cylinders of an overhead cam engine.

The oil separator is mounted in the engine cam cover and includes a longitudinally elongate chamber with a crankcase vapor inlet near one end and an outlet to the cylinders in an upper portion near the other end. An open and relatively large separation portion adjacent the inlet extends to a floor sloping downwardly toward the outlet end to define a sump with a drain for returning collected oil to the crankcase.

Preferably the inlet is through a depending tube with a large entrance and positioned to block direct entry of oil droplets thrown from the adjacent camshaft and other moving parts of the engine. A shelf may be provided over the sump toward the outlet end to block direct passage from the sump to the outlet. The shelf preferably slopes downwardly toward the inlet to carry oil back to the sloping floor and the sump.

The chamber may be provided with baffles to increase the length of the flow path from the inlet to the outlet so that a longer travel will encourage droplet separation. However, a chamber free of such baffles is preferred at present because the slower flow rate resulting from the enlarged cross section area of the shortened path is believed to result in even more droplet separation.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
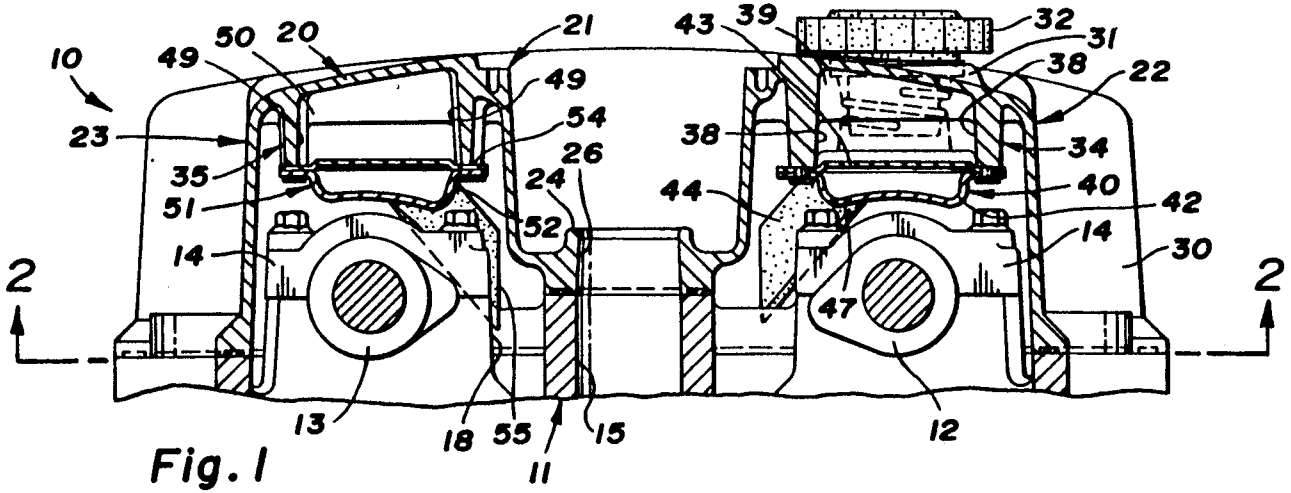
FIG. 1 is a cross-sectional view from the plane of the line 1—1 of FIG. 2 showing the relation of the cam cover, oil separators, cylinder head and camshafts of a DOHC engine.
Figure 3:
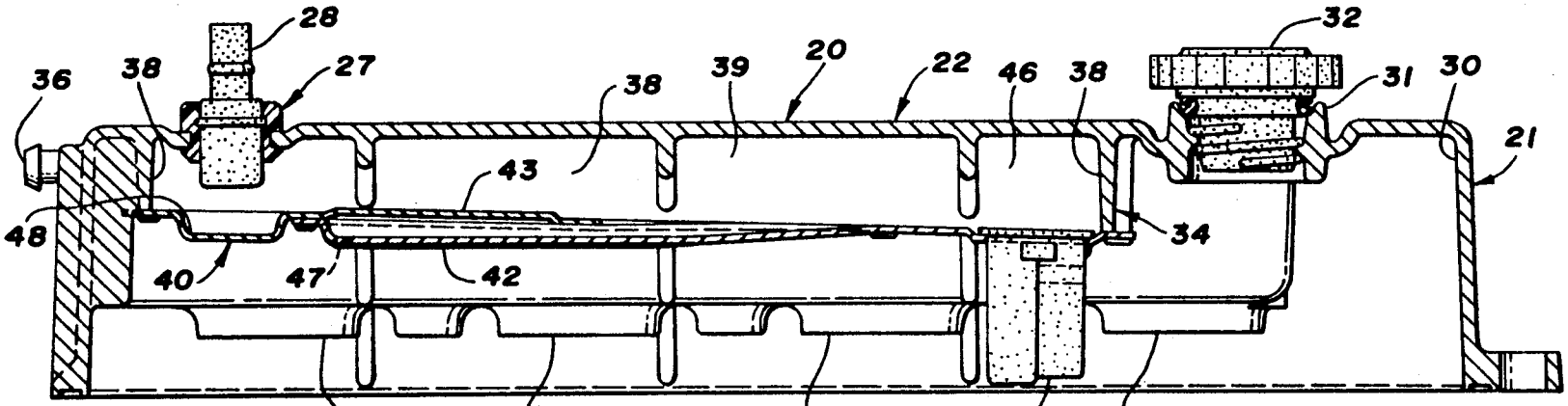
FIG. 3 is a cross-sectional view from the plane of the line 3—3 of FIG. 2 showing a PCV valve associated oil separator.
Figure 2:
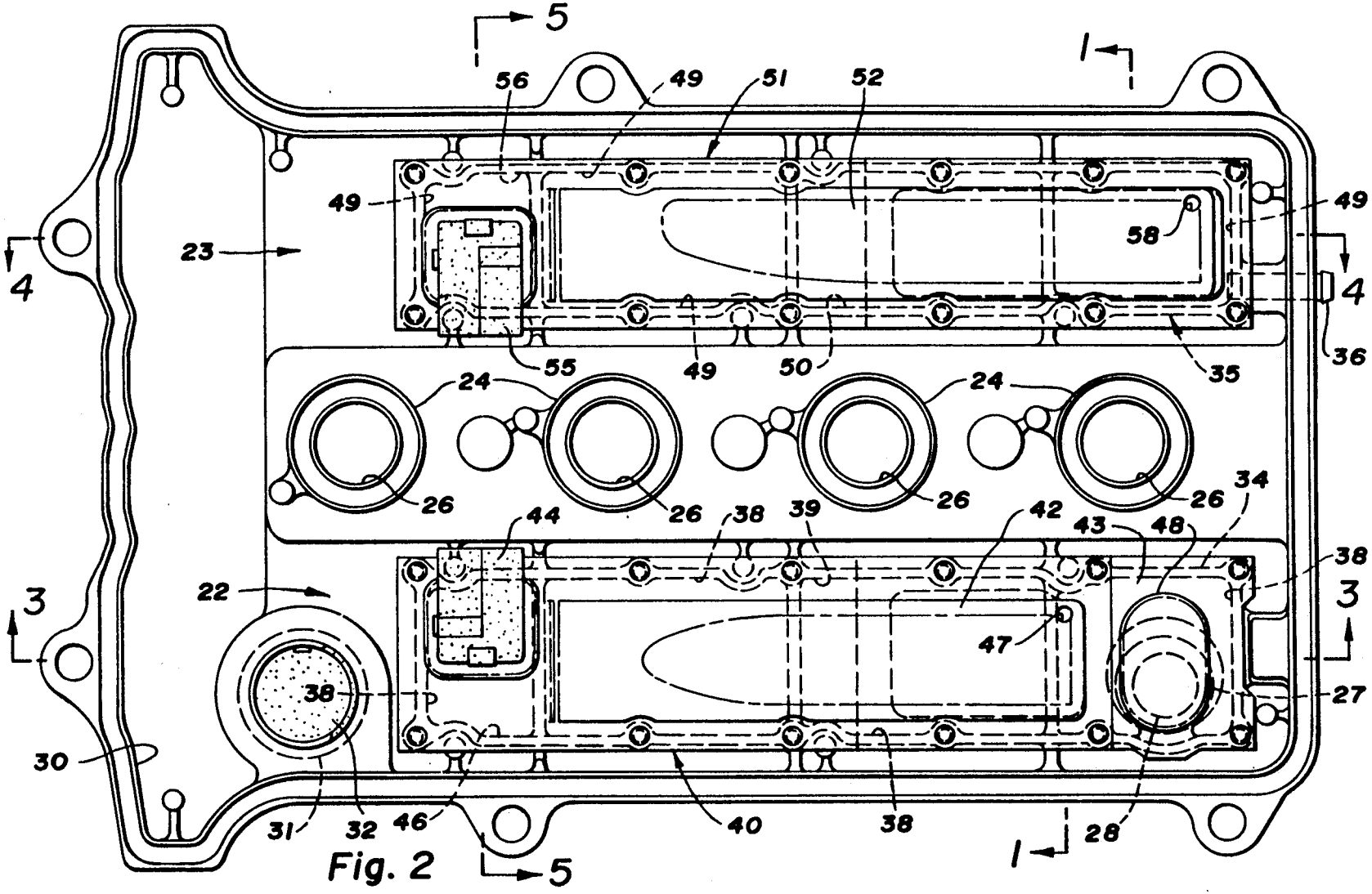
FIG. 2 is a lower plan view of the cam cover from the line 2—2 of FIG. 1 showing a preferred embodiment of oil separators according to the invention.
Figure 4:
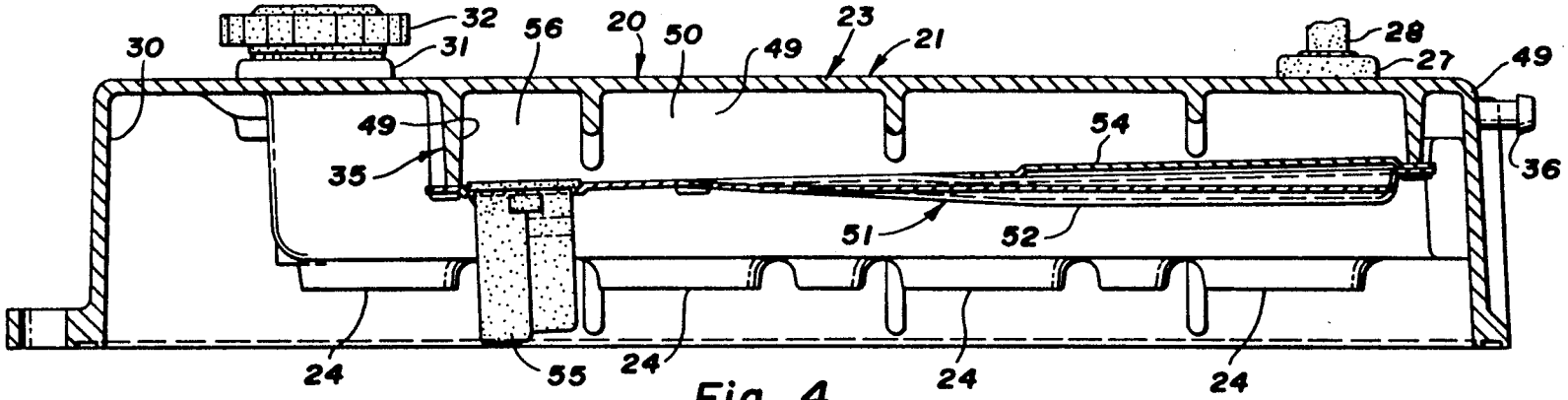
FIG. 4 is a cross-sectional view from the plane of the line 4—4 of FIG. 2 showing a low pressure vent connection associated oil separator.
Figure 5:
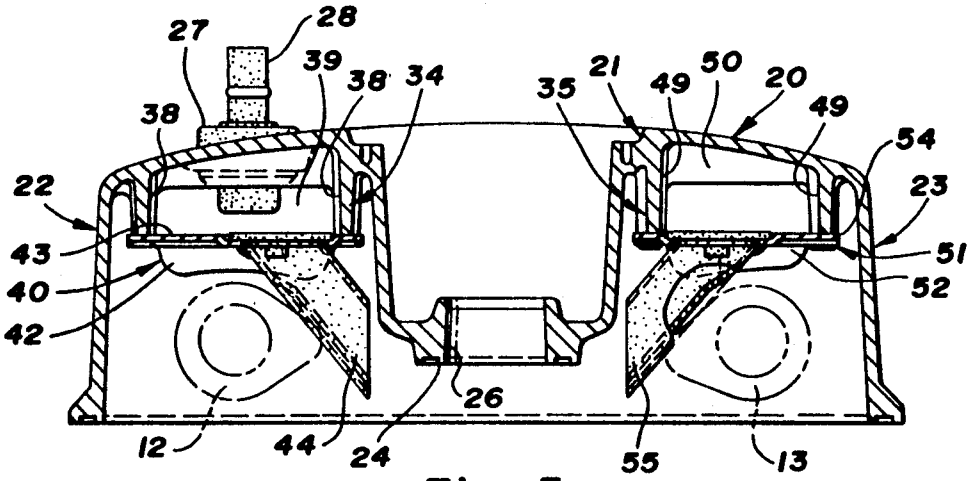
FIG. 5 is a cross-sectional view from the plane of the line 5—5 of FIG. 2 showing the inlet tubes and their relation with the camshafts of the associated engine.

Referring first to FIGS. 1-5 of the drawings, numeral 10 generally indicates a double overhead cam (DOHC) type of OHN internal combustion engine having a cylinder block, not shown, with a plurality of cylinders, not shown, closed by a cylinder head 11.

The head 11 carries a first camshaft 12 for operating the dual intake valves, not shown, of each cylinder and a second camshaft 13 for operating the dual exhaust valve, now shown. Bearing caps 14 are used to retain the camshafts on the head. The head also includes threaded openings 15 for receiving spark plugs, not shown between the camshafts at the ends of the cylinders. Drain openings 18 in the cylinder head allow oil discharged from the camshaft bearings, valve lifters and camshaft drive, not shown, to the enclosed areas above the cylinder head to return to the engine oil pan, not shown.

A cam cover 20 is mounted on the cylinder head 11 and encloses the areas above the camshafts 12, 13 and the camshaft drive. The cam cover includes a housing 21, which may be formed, as by casting or molding of any suitable material, such as aluminum, plastic or the like.

The housing includes parallel longitudinally extending raised portions 22, 23 which enclose the area around the two camshafts. Between the enclosed camshaft areas, the housing 21 has a lowered section with bosses 24 engaging the head and defining openings 26 for receiving the spark plugs with clearance for a socket wrench.

On the top of the raised portion 22 near one end, a grommet 27 is mounted carrying a PCV valve 28 vertically in the housing 21 and protruding into the enclosed area above the camshaft 12. At the other end, adjacent a cam drive chamber 30, a boss 31 defines a fill opening receiving a fill plug 32.

On the end of the raised portion 23 opposite from the cam drive chamber 30, a nipple 36 is mounted in the end wall provides a hose connection extending into an upper part of the raised portion.

Within the housing raised portions 22, 23, above the intake and exhaust camshafts 12, 13, respectively, there are provided a first oil separator 34 and a second oil separator 35, each formed according to the invention. Though similar in construction, the separators have sufficient differences to merit their separate description.

The first oil separator 34 includes a top wall formed by the top of the housing raised portion 22. Side walls 38, formed by ribs depending from the housing top wall, define a longitudinally elongate chamber 39 extending above the camshaft 12 from the PCV valve 28 to a point near but spaced from the fill boss 31. The chamber is closed by a floor assembly 40 having a sump portion 42 and a shelf portion 43.

A generally rectangular inlet tube 44 is mounted in the floor assembly 40 near the end opposite the PCV valve and angles downward past the adjacent camshaft 12. The lower end of the tube faces away from the camshaft to prevent the direct entry of oil droplets and is cut at an angle to provide an enlarged inlet opening.

The floor 40 extends from the inlet end supporting the inlet tube 44 to the outlet end that communicates with the PCV valve. Part of the chamber 39 at and adjacent to the inlet tube 44 acts as a separation portion 46 constituted as an enlarged open space. In this portion the floor is slightly sloped toward the inlet tube although it could be level or otherwise directed. Between the separation portion and the outlet end, at least part of the floor slopes slightly downward toward the outlet end to form the sump portion 42 having its lowest point near but short of the PCV valve location. A small drain opening 47 is provided at the low portion of the sump.

Part of the floor 40 extends beyond the sump under the PCV valve and may include a shallow recess 48 to clear the end of the valve. This portion is preferably formed integral with the shelf 43 that extends over the sump for about half the length of the sloping floor portion. The shelf and the connected floor portion under the PCV valve preferably are sloped slightly downward toward the inlet end of the chamber.

The second oil separator 35 is similar, having a top wall formed by the top of the housing raised portion 23, side walls 49 formed by ribs depending from the housing top wall to define a longitudinally elongate chamber 50, a floor assembly 51 having a sump portion 52 and a shelf portion 54. A generally rectangular inlet tube 55 is mounted in the floor assembly 51 near the end opposite the nipple 36 and angles downward past the adjacent camshaft 13 with an angled lower inlet end facing away from the camshaft to deter entry of oil drops and provide an enlarged inlet opening.

The floor 51 extends from the inlet end at tube 55 to an outlet end that connects with the nipple 36. Part of the chamber 50 near the inlet tube 55 acts as a separation portion 56 formed as an enlarged open space wherein the floor is optionally sloped slightly toward the inlet tube 55. Between the separation portion and the outlet end, part of the floor slopes slightly downward toward the outlet end to form the sump portion 52 having its lowest point near the end below the entry of the nipple 36 into the chamber 50. A drain opening 58 is provided at the lower point of the sump 52. The shelf 54 extends over the sump from the end below the nipple for about half or two-thirds the length of the sloping floor. The shelf 54 slopes slightly downward toward the chamber inlet.

As installed, the first oil separator 34 is normally connected through the PCV valve 28 to the higher vacuum portion of the engine induction system downstream of the usual throttle valve. The second oil separator 35 is normally connected to the lower vacuum portion of the induction system upstream of the throttle valve.

Under closed and part throttle conditions of low or moderate load whereby blow by flow to the crankcase is normally low, the crankcase ventilation flow from the crankcase is through the first oil separator 34 is the induction system after the throttle with the flow rate controlled by the PCV valve 28. Make up air is drawn into the crankcase system from the induction system before the throttle through the nipple 36 and the second coil separator 35. However, under full open throttle and some transient conditions, the blow by flow to the engine crankcase may exceed the controlled flow through the first oil separator. The excess flow is then directed through the second oil separator 35 to the induction system before the throttle by way of the nipple 36. Thus, both separators 34, 35 are required to perform an oil separation function under some conditions although the second separator 35 is more often used as a path for air inlet to the engine crankcase.

OPERATION

During engine operation, and especially at high speed, a substantial amount of oil is delivered to the engine camshaft bearings and hydraulic valve lifter and/or other moving parts of the valve gear in the upper portion of the cylinder head. The oil is thrown off by the rotating camshafts and further mixed with the air which is made turbulent by the motion of the moving parts as well as by the flow of crankcase gas into the crankcase ventilation system. The oil separators operate in the following manner to remove from the air passing through them a large amount of the entrained oil which would otherwise be exhausted into the engine intake.

The optional inlet tubes 44, 55 are positioned with the enlarged angled opening away from the direct path of oil thrown from the camshafts and other parts and at points of relatively lower turbulence. This minimizes entry of oil into the separators as does the enlargement of the inlet opening which allows an initial slow rate of inlet flow.

From the inlet tubes, the air passes into the separation portions which have larger flow area to slow the flow and allow oil droplets to coalese and settle out on the floors of the separators. Here, the direction of air flow urges the oil along the floor and down the sloping portions to the sumps 42, 52, where it collects and passes through the drain openings 47, 58 to the cylinder head for return to the crankcase via drain openings 18.

The oil freed air passes along the upper portions of the separators to the outlet ends where it exits through the PCV valve in separator 34 or the nipple in separator 35. The shelf portions 43, 54 located between the sumps and the upper portions at the outlet ends of the separators help prevent oil in the sumps from being reentrained in the exiting air by the turbulent conditions or by the centrifugal force of driving maneuvers which urge the collected oil toward one or the other ends of the respective separator.

When the engine is shut down in a level position, the oil on the sloping shelves drains to the floors and thence to the drains for return to the crankcase while oil in the separation portions may run out through the inlet tubes or along the sloping floors to the drains.

ALTERNATIVE EMBODIMENTS

Figure 6:
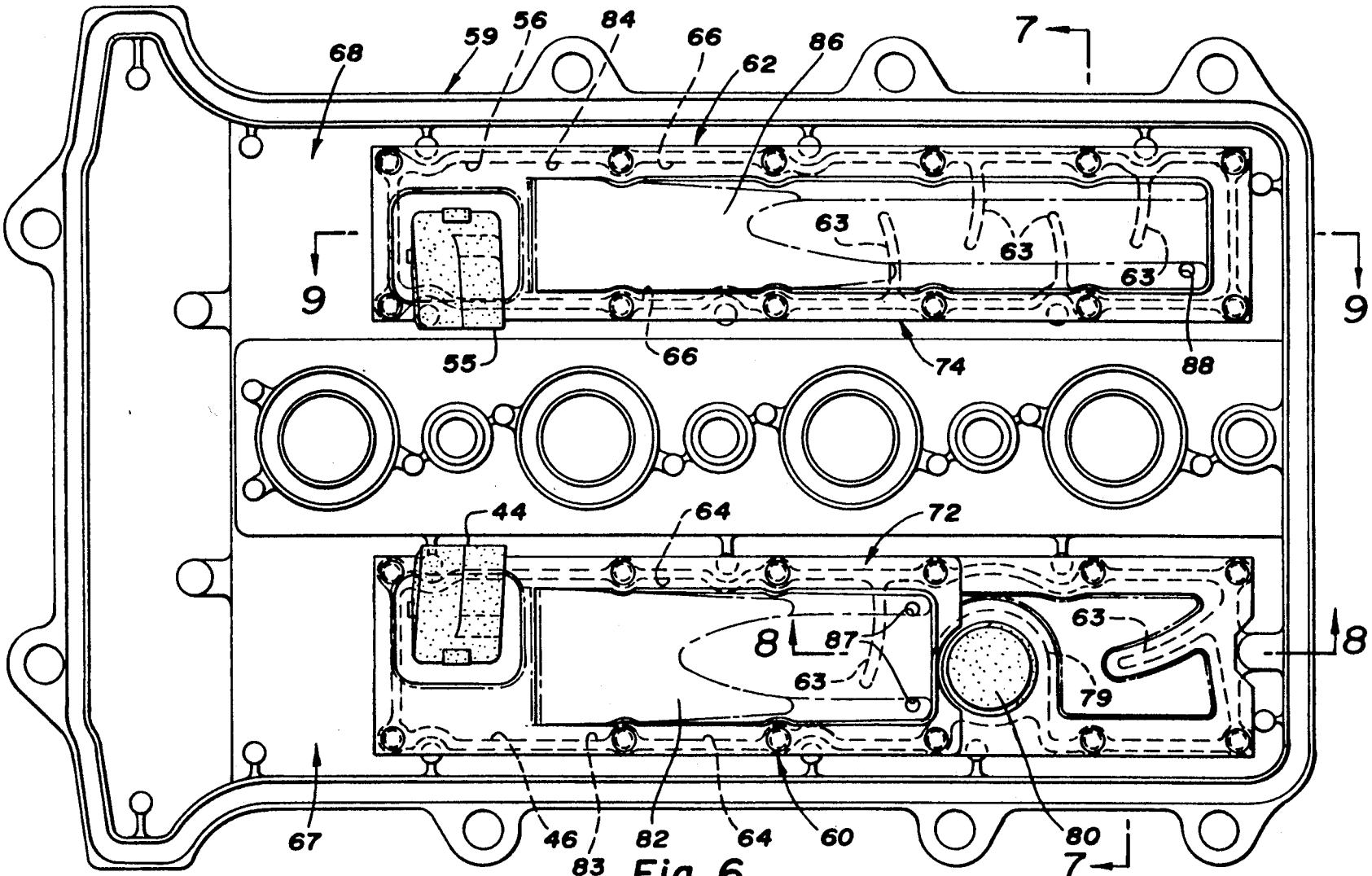
FIG. 6 is a lower plan view similar to FIG. but showing an alternative embodiment of cam cover and oil separators according to the invention.
Figure 8:
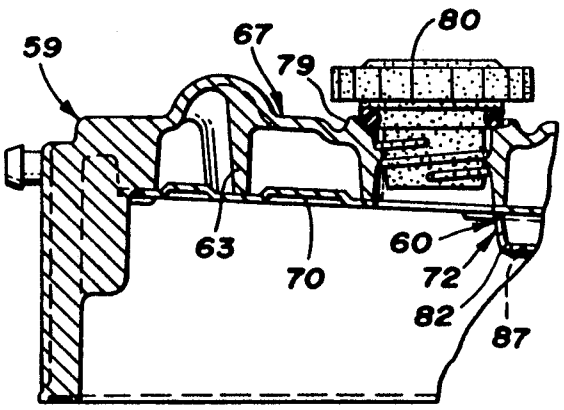
FIG. 8 is a cross-sectional view from the plane of the line 8—8 of FIG. 6 showing the PCV valve associated oil separator and oil filler.
Figure 7:
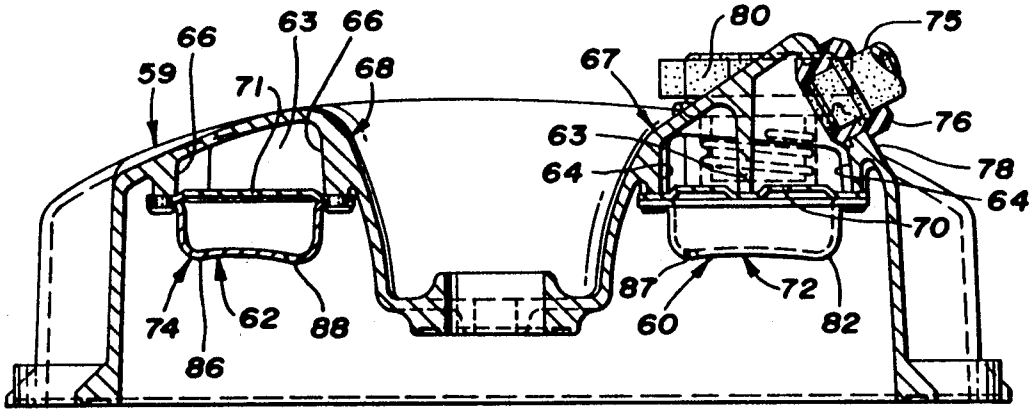
FIG. 7 is a cross-sectional view from the plane of the line 7—7 of FIG. 6 showing the PCV valve mounting and other features.
Figure 9:
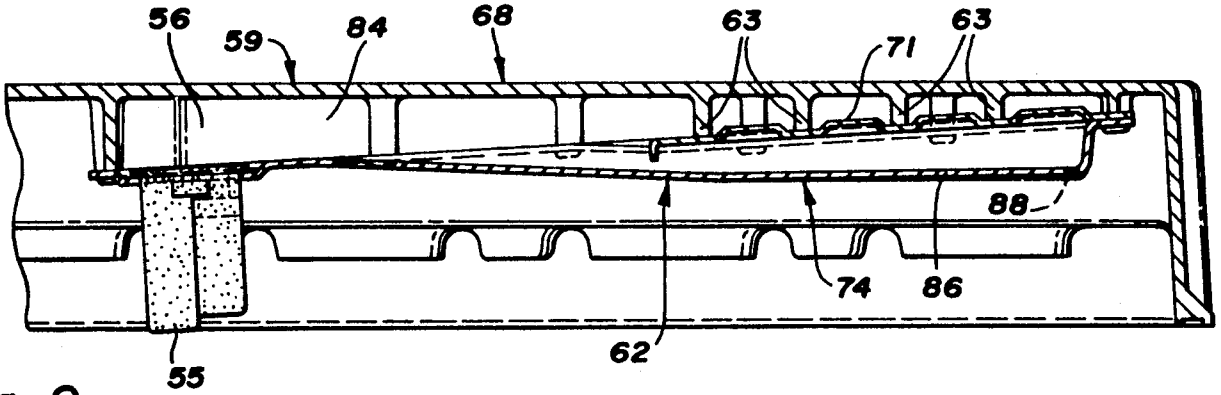
FIG. 9 is a cross-sectional view from the plane of the line 9—9 of FIG. 6 showing the low pressure vent connection associated oil separator.

FIGS. 6–9 show an alternative embodiment of cam cover 59 having a first oil separator 60 and a second oil separator 62 having features according to the invention. The arrangements are similar to the cover 20 and oil separators 34, 35 previously described but differ in certain aspects noted below.

In cover 59, the separators 60, 62 include cast-in ribs 63 extending from the side walls 64, 66 to form labyrinths in the upper portions of the raised portions 67, 68 above the shelf portions 70, 71 of the floor assemblies 72, 74. The PCV valve 75 and its supporting grommet 76 are mounted at an angle in a sloping roof portion 78 of the raised portion 67. The oil fill boss 79 and fill plug 80 are located adjacent to the PCV valve with the filler opening extending through the floor 72. Air flow to the valve 75 thus passes around the boss 79 which acts similar to another rib 63 in the upper section of the separator 60. Because of the filler location, the sump portion 82 of the first separator 60 is shorter than the comparable sump 42 of the first described embodiment, but it operates in a similar manner though with a smaller storage volume.

The inlet tubes 44, 55 and the separation portions 46, 56 of the separator chambers 83, 84 are like those of the first embodiment, but the floor assemblies 72, 74 differ in having somewhat higher slopes to the sloping walls of the sump portions 82, 86 and shelf portions 70, 71. The amount of slope is variable depending upon the available height of the cover raised portions and the camshafts and other gear covered thereby. A slope of three to five degrees is probably more effective but a slope as low as one degree should provide an advantage over a level floor or shelf in aiding the draining of collected oil. One or more drain openings 87, 88 are provided at the outlet end of each sump 82, 86 as in the first described embodiment.

In the various embodiments, portions of the floor extend closely above the associated camshafts 12, 13 so that some of the floor may need to be horizontal rather than sloped as desired. However, the floor may be wrapped around the upper portion of the camshaft to provide clearance but allow the outer edge or edges of the floor to include the desired slope toward the sump and the outlet end of the respective separator chamber.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine cam cover for an engine having a longitudinal overhead camshaft, the cam cover having an internal oil separator for crankcase ventilation gas flow, said separator comprising a side wall and a floor cooperating with a top wall of the cam cover to define a longitudinally elongate chamber in an upper portion of the cam cover adjacent the camshaft;

an inlet opening to the chamber longitudinally near one end for communication of the chamber with the cover interior generally adjacent the camshaft location as installed, an outlet opening from the chamber longitudinally near an opposite outlet end and in an upper portion adjacent the top wall to allow the discharge of crankcase gases, the chamber including a separation portion of relatively large flow area near the inlet for encouraging the collection of oil droplets on the floor, the floor having a portion sloping gradually downwardly toward the outlet end of the chamber and defining a shallow sump for oil collection in a lower portion toward the outlet end, and, a drain in the sump toward the outlet end to return collected oil to the cover interior and to a connected engine crankcase.

2. An engine cam cover as in claim 1 and further comprising a tube extending from the inlet downwardly adjacent the location of an associated moving engine part and shielding the inlet against the direct entry of oil droplets thrown from said moving part, the tube being of relatively large flow area at its entrance to minimize the entrainment of oil droplets in the entering gas stream.

3. An engine cam cover as in claim 1 and further comprising a shelf extending over the sump toward the outlet end and separating the upper and lower portions of the chamber toward the outlet end to restrict the carryover of oil from the sump to the outlet.

4. An engine cam cover as in claim 3 wherein the shelf slopes generally downward the inlet end to drain oil collected thereon back onto the lower wall for delivery to the sump.

5. An engine cam cover as in claim 2 wherein the chamber is free of baffles that interfere with direct flow from the inlet to the outlet.

6. An engine cam cover as in claim 2 wherein the chamber includes a plurality of baffles that alter the flow path from the inlet to the outlet to increase its length.

* * * * *